United States Patent [19]

Yuda

[11] Patent Number: 4,924,758

[45] Date of Patent: May 15, 1990

[54] COMPACT FLUID OPERATED APPARATUS AND METHOD

[76] Inventor: Lawrence F. Yuda, P.O. Box 176, Westminster, S.C.

[21] Appl. No.: 318,852

[22] Filed: Mar. 6, 1989

Related U.S. Application Data

[63] Continuation-in-part of Ser. No. 227,235, Aug. 1, 1988, and a continuation-in-part of Ser. No. 25,596, Mar. 13, 1987, abandoned.

[51] Int. Cl.[5] ..... F01B 29/00

[52] U.S. Cl. ..... 92/128; 92/165 R; 92/169.1

[58] Field of Search ..... 92/85 R, 85 B, 128, 92/165 R, 169.1, 128, 165 R, 169.1; 91/31, 405; 285/321, 918, 921; 403/326

[56] References Cited

U.S. PATENT DOCUMENTS

| | | | |
|---|---|---|---|
| 3,322,039 | 5/1967 | Madland | 91/405 |
| 3,388,634 | 6/1968 | Madland | 92/85 B |
| 3,494,652 | 2/1970 | Langland | 92/128 X |
| 3,650,182 | 3/1972 | Phillips | 92/128 |
| 3,667,785 | 6/1972 | Kapeker | 285/321 X |
| 4,167,134 | 9/1979 | Yuda | 92/128 X |
| 4,565,506 | 1/1986 | Williams | 92/128 X |

FOREIGN PATENT DOCUMENTS

| | | | |
|---|---|---|---|
| 543733 | 3/1942 | United Kingdom | 285/321 |

*Primary Examiner*—Edward K. Look
*Assistant Examiner*—John Ryznic
*Attorney, Agent, or Firm*—Bailey & Hardaway

[57] ABSTRACT

A fluid operated apparatus having a cylinder assembly, a piston and a rod is illustrated wherein cap members are provided with a first circumferential groove and a reduced end portion while a second circumferential groove is carried opposite the first circumferential groove within the cylinder assembly forming a seat for a deformable ring. A method of assembling the fluid operated apparatus contemplates inserting an end cap into the cylinder and then mounting a deformable ring in an adjacent groove in the cylinder and then forcing the cap out so that the ring passes over a reduced conical end portion of the cap and is positioned in the seat formed between the opposed grooves for deforming the ring. Improved cushioning against shock and noise is provided by an air distribution system within end caps having enhanced stability.

2 Claims, 7 Drawing Sheets

FIG. 2
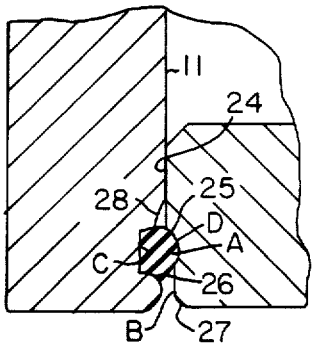
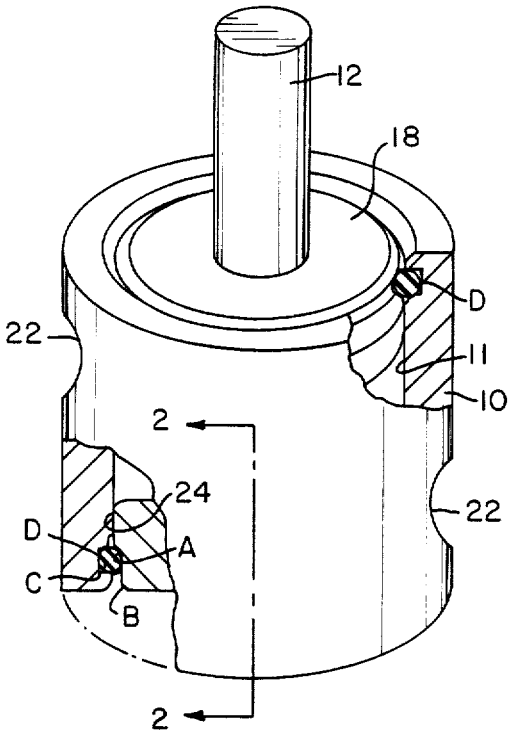
FIG. 1
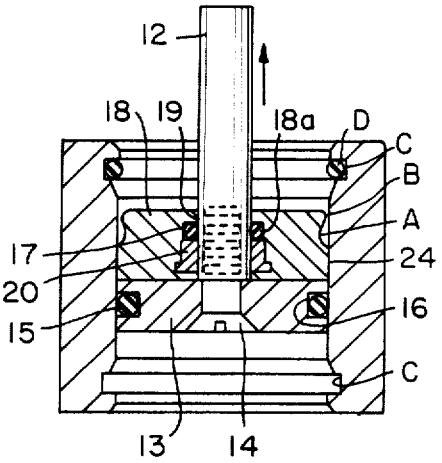
FIG. 3

FIG. 4
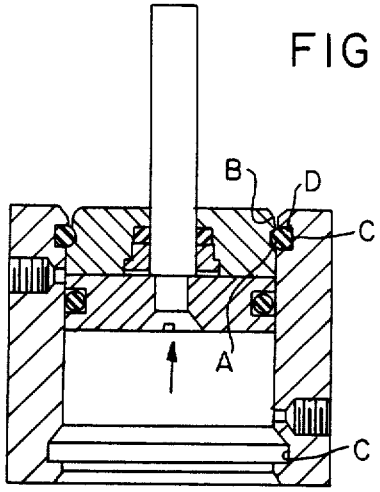
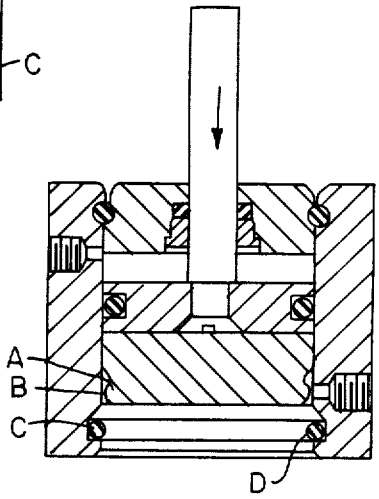
FIG. 5
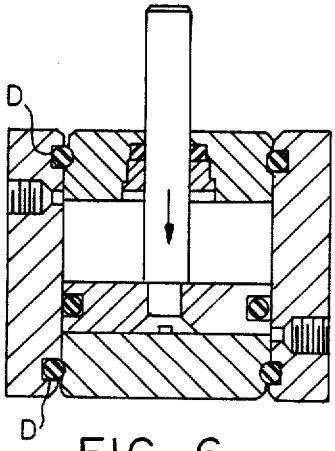
FIG. 6

FIG. 7
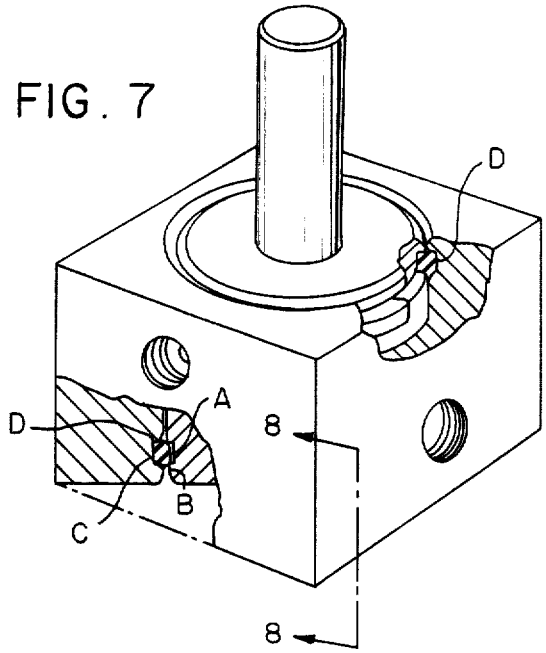
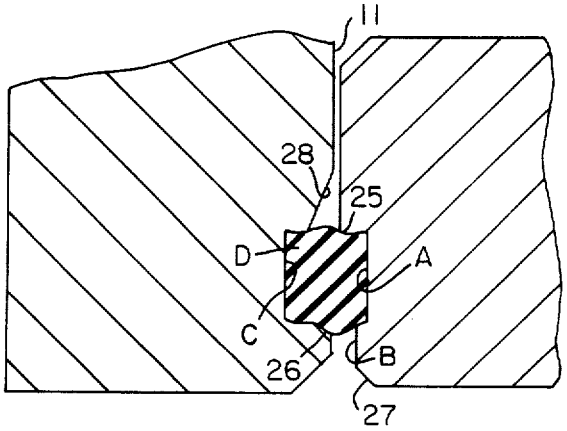
FIG. 8

COMPACT FLUID OPERATED APPARATUS AND METHOD

This application is a Continuation-in-Part of Yuda Application Ser. No. 07/227,235, filed Aug. 1, 1988, and Application Ser. No. 07/025,596, filed Mar. 13, 1987.

BACKGROUND OF THE INVENTION

This invention relates to compact cylinders which are useful for a variety of purposes but which may preferably be of the general type illustrated in U.S. Pat. No. 4,167,134. As is customary, the end caps of the cylinder of the patent are secured by a mechanical bond provided by a metallic ring carried within a groove in the cylinder wall and bearing against a surface of the end cap for retaining same within the cylinder walls. An O-ring constructed of deformable material is carried within a groove within the end cap and provides a fluid seal. Such cylinders are useful in connection with robotic grippers, for example, and U.S. Pat. Nos. 4,566,727 and 4,492,400 are exemplary of such constructions.

Since such end caps may often move to a limited extent axially as provided by the mechanical bond, the end cap may strike the mechanical bonding member resulting in noisy operation. Since more than one groove must be provided within the cylinder walls and end caps for accommodating the mechanical bonding member and the sealing member respectively, the grooves may not be carried opposite each other but rather must be longitudinally spaced so that a relative thickness in the area of the end caps is necessitated.

Accordingly, an important object of the present invention is the provision of a more compact cylinder wherein the end caps can be made thinner because of opposed grooves provided in the walls of the cylinder and end caps forming a seat for single deformable members which serves both to bond the end caps within the cylinder walls as well as a sealing member therebetween.

Another important object of the invention is the provision of a deformable resilient bond between the end caps and the cylinder walls adjacent their ends so as to function as a sound reducing means since there is no mechanical bond as afforded by a metallic ring as would result in noisy operation but rather the resilient deformable member which serves as a sealing and a bonding member also serves to cushion sound as well as shock.

Still another important object of the invention is the provision of a tapered ramp formed by a substantially conical surface at the open end of each of the caps facilitating assembly by avoiding twisting of the O-ring together with a retaining ridge which extends inwardly short of a center line of the O-ring and beyond the initial groove surface of the cylinder to deform the ring in such a way as to provide even greater force requirements for dislodging the ring in an outward direction than forces required to dislodge the end caps of the other embodiments herein.

SUMMARY OF THE INVENTION

It has been found that a more compact cylinder or fluid operated apparatus may be provided by utilizing opposed grooves in the cylinder walls and in the end cap members to form seats for deformable rings which act as sealing members and afford a bond or a retaining member for positioning the end cap within the respective ends of the cylinder walls on either side of the piston.

The method of assembling the apparatus contemplates first inserting or sliding an end cap into one end of the cylinder and mounting or installing an O-ring or other deformable resilient ring into an adjacent groove in the cylinder wall. The cap is then forced outwardly by action of the piston when a force is exerted against the rod to cause a reduced end of the cap to pass over the deformable ring so that the ring becomes seated between opposed grooves in the cap and in the cylinder wall respectively. An enlarged shoulder is carried by the cap member which prevents further outward movement of the end cap so that the end cap is retained within the cylinder walls and a seal is provided between the cap and the cylinder walls.

It has further been found that a ramp may be defined by a substantially conical surface extending from an outer end of the cap inwardly of the circumferential groove of the cylinder and tapering inwardly progressively enlarging a circumference of the end cap defined by the ramp terminating short of the center line of the deformable ring. Such a construction increases the force required for outer dislodging of the end cap and facilitates assembly since there is a reduced tendency for twisting of the O-ring as the ramp passes over the O-ring.

An end cap has been provided which includes a resilient mounting adjacent one end for positioning same within the cylinder together with a pair of spaced peripheral surfaces carrying an annular groove for receiving fluid and distributing same across a peripheral end portion of the end cap to an annular terminal recess for distributing fluid across a passageway delivering fluid for breakaway to a terminal recessed end portion of the end cap.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 is a perspective view illustrating a compact fluid operated apparatus with parts broken away for illustrating the structure for retaining the end caps while at the same time providing a seal in accordance with the invention, FIG. 2 is an enlarged transverse sectional elevation taken on the line 2—2 in FIG. 1, FIG. 3 is a sectional elevation at a reduced scale illustrating a first step in the installation of a resilient deformable ring to position one of the end caps in accordance with the method of the invention, FIG. 4 is a sectional elevation illustrating a next step in the assembly of the apparatus wherein the end cap is forced by the cylinder over the deformable ring at a reduced end seating the deformable ring in the area between the opposed grooves which forms a seat for the ring, FIG. 5 is a sectional elevation similar to FIG. 2 wherein a second end cap has been inserted and a resilient deformable ring amounted in a groove adjacent the end of the cylinder walls, FIG. 6 is a sectional elevation similar to FIG. 4 showing the final step in forcing the other cap outwardly to seat the deformable ring, FIG. 7 is a perspective view illustrating a modified form of the invention wherein the cylinder housing is square and the deformable ring of a rectangular or square configuration having flats, FIG. 8 is an enlarged sectional elevation taken on the line 8—8 in FIG. 7 illustrating the deformable ring and associated groove and cap constructions.

DESCRIPTION OF A PREFERRED EMBODIMENT

Figure 9:
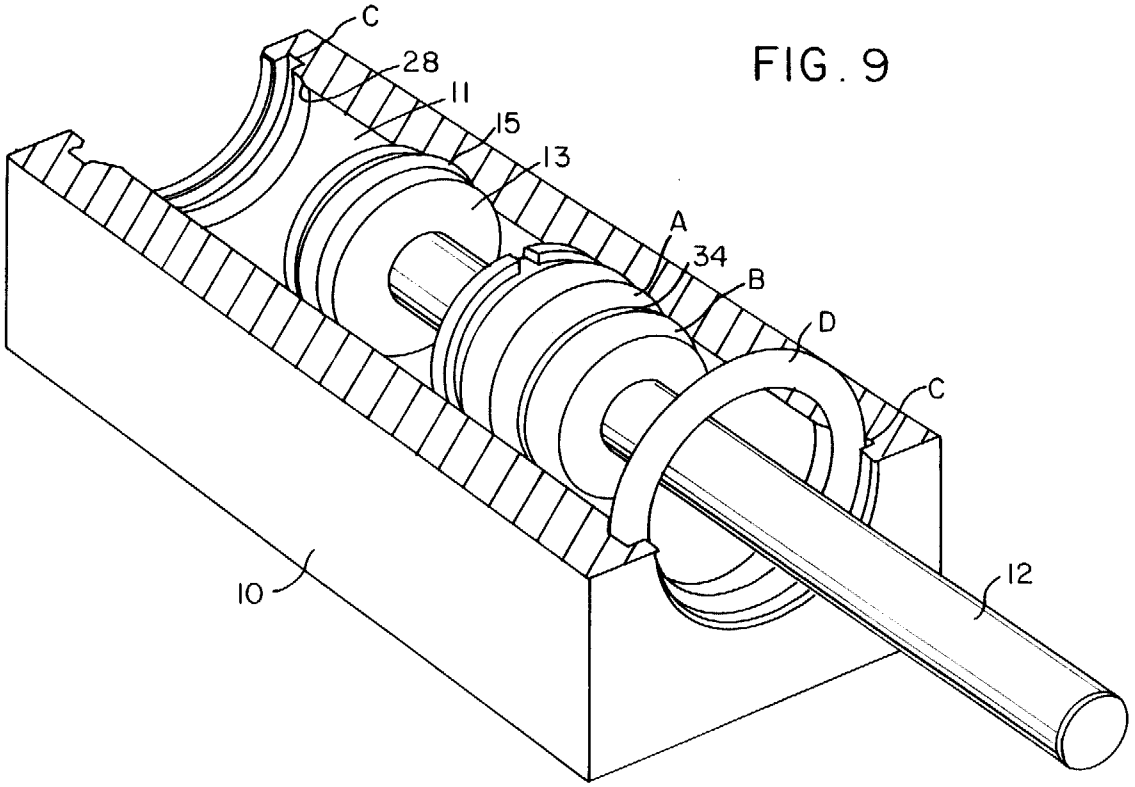
FIG. 9 is a perspective view illustrating a first step in the assembly of the cylinder and piston wherein the piston and piston rod are inserted in the cylinder and O-ring positioned within a groove within the cylinder.
Figure 11:
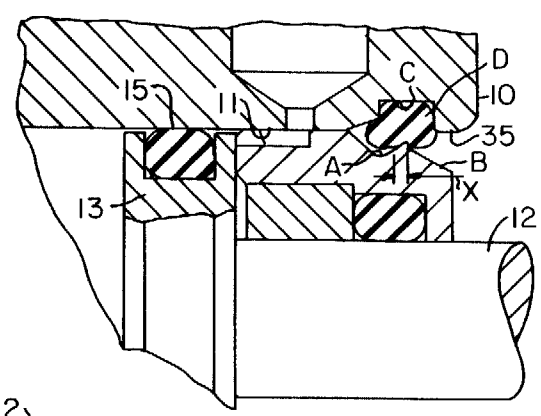
FIG. 11 is a transverse sectional elevation further illustrating the assembly of the apparatus wherein the end cap is passing beneath the O-ring preparatory to seating the O-ring in the groove of the end cap.
Figure 10:
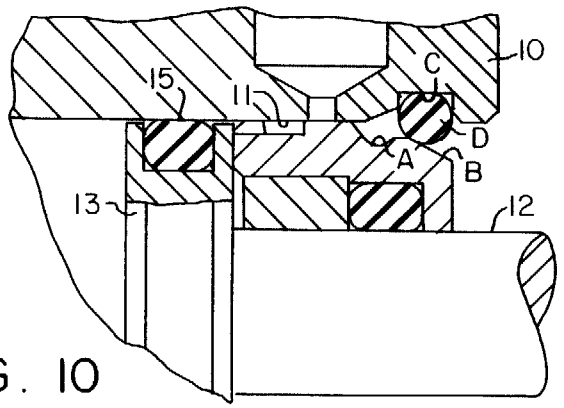
FIG. 10 is a transverse sectional elevation illustrating a second step in the assembly operation wherein the end cap is moved outwardly with the ramp passing through the O-ring.

A fluid operated apparatus having a cylinder assembly, a piston and a rod carried thereby is illustrated. Cap members are carried within the cylinder assembly on each side of the piston having a first circumferential groove A, and a reduced end portion B extending from the groove to an outer end of the cap member. A second circumferential groove C is carried within the cylinder assembly adjacent each end thereof opposite the first circumferential groove. A deformable ring D is carried within a space defined between the first and second circumferential grooves in a compressed deformed state. Thus, a fluid seal is provided between a cylinder assembly and a cap member while the cap member is retained within the cylinder. Beveled surfaces are provided opposite retaining edges of respective grooves and at an outer edge of said cap.

The method of assembling such an apparatus contemplates inserting one of the end caps into the cylinder past one of the grooves in the cylinder assembly on one side of the piston. A deformable sealing ring is mounted in said one of said grooves, and the reduced end portion of the cap is forced past the sealing ring until the sealing ring seats in opposed annular grooves. The o&her of the end caps is inserted into the cylinder past the other of the grooves in the cylinder on the other side of the piston. A deformable sealing ring is mounted in the other of the grooves, and a reduced end portion of the cap is forced past the sealing ring until the sealing ring seats in opposed annular grooves.

Referring more particularly to FIG. 1, a fluid operated apparatus or air cylinder and the like is illustrated as having a cylinder assembly 10 provided with inner walls 11. A piston rod 12 is connected to a piston 13, FIGS. 3–6. The rod 12 is connected to the piston as by a threaded bolt 14 which is threadably received within the piston rod. A sealing member is provided in the form of an O-ring 15 carried within a groove 16 in the piston. Sealing means are provided by an O-ring 17 carried within a groove 18*a* within a cap 18 which provides an opening 19 for slideably receiving the rod 12. A retaining member 20 is provided for seating the O-ring.

It will be observed that fluid ports 22 are provided adjacent each end of the cylinder 10. The cap members are each provided with an annular groove A which joins a reduced end portion B. Thus, an enlarged shoulder 24 is formed on the inner end of the respective end caps. An annular groove C is provided in the respective ends of the cylinder walls 11 for accommodating a resilient deformable member such as the O-ring D which may be constructed as of the usual rubbery material. The opposed retaining edges of the respective grooves illustrated at 25 and 26 are beveled, and a bevel 27 is provided at an outer edge of the cap.

FIGS. 7 and 8 illustrate a modified form of the invention wherein a square cylinder is utilized and a square deformable ring D is illustrated. FIG. 8 shows a deformation of the ring against a force tending to dislodge the end cap outwardly. As in the first embodiment a tapering surface 28 is provided to facilitate positioning of the deformable ring D with the groove C. A beveled edge is illustrated at 27 at an outer edge of the cap while opposed bevels 25 and 26 are carried at opposite edges of the grooves A and C respectively.

The fluid operated apparatus of FIGS. 9–13 is illustrated as having a cylinder assembly, a piston and a rod carried thereby. Cap members are carried within said cylinder assembly on at least one side of said piston having a first circumferential groove A therein. A reduced end portion B extends from the groove A to an outer end of the cap member. A second circumferential groove C is carried within the cylinder assembly adjacent an end thereof opposite the first circumferential groove of the cap member. A deformable ring D is carried within a space defined between the first and second circumferential grooves in a compressed deformed state for positioning said cap member within said cylinder assembly and providing a fluid seal between the cylinder assembly and the cap member. The reduced end portion B includes a ramp defined by a substantially conical surface extending from an outer end of the end cap inwardly of the second circumferential groove and tapering inwardly progressively enlarging a circumference of the end cap defined by the ramp terminating short of a center line of the deformable ring. Thus, a compact cap member and a correspondingly compact apparatus is provided as the single deformable ring serves both to position the end cap and to provide a fluid seal.

The ramp extends continuously expanding at an angle on the order of about 20°. The ramp and the second groove C form a retaining ridge having a flat apex terminating short of said center line extending inwardly deforming the deformable ring. The deformable ring D is preferably of substantially circular cross section carried within an arcuate trough defining a part of said second groove C having a radius substantially less than a radius of said deformable ring and positioned inwardly thereof toward said second groove and away from and end of said cylinder. The second groove commences inwardly of the first groove outwardly of a center line of the deformable ring. The second groove commences outwardly of the center line by a distance of on the order of about 0.01 inch.

Referring more particularly to FIG. 9–13, a cylinder is illustrated at 10 having inner walls 11. A piston rod 12 has connection with the piston 13 which is provided with an O-ring 15. Fluid ports 22 are provided adjacent each end of the cylinder and communicate through grooves 30 and passageways 30a in the end caps with the interior of the cylinder on either side of the piston 13.

Figure 12:
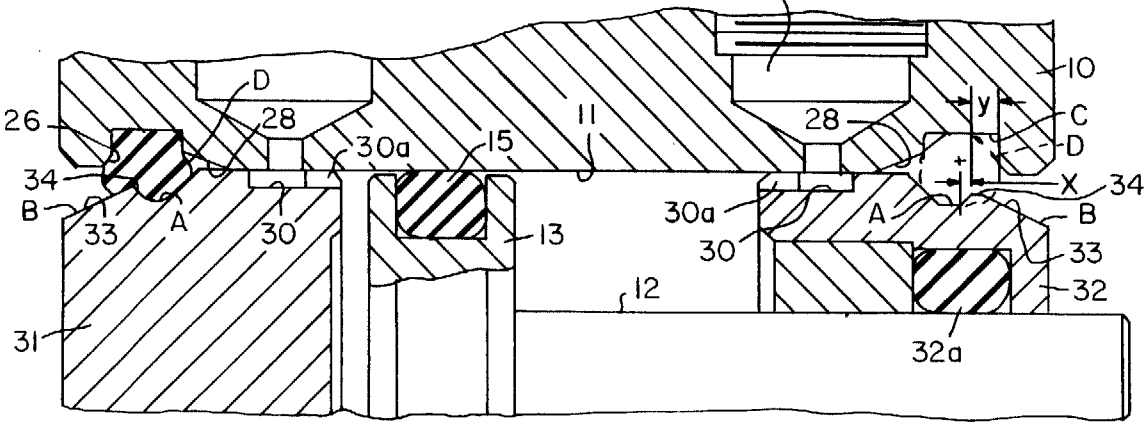
FIG. 12 is a transverse sectional elevation illustrating the assembly with the end caps seated.
Figure 13:
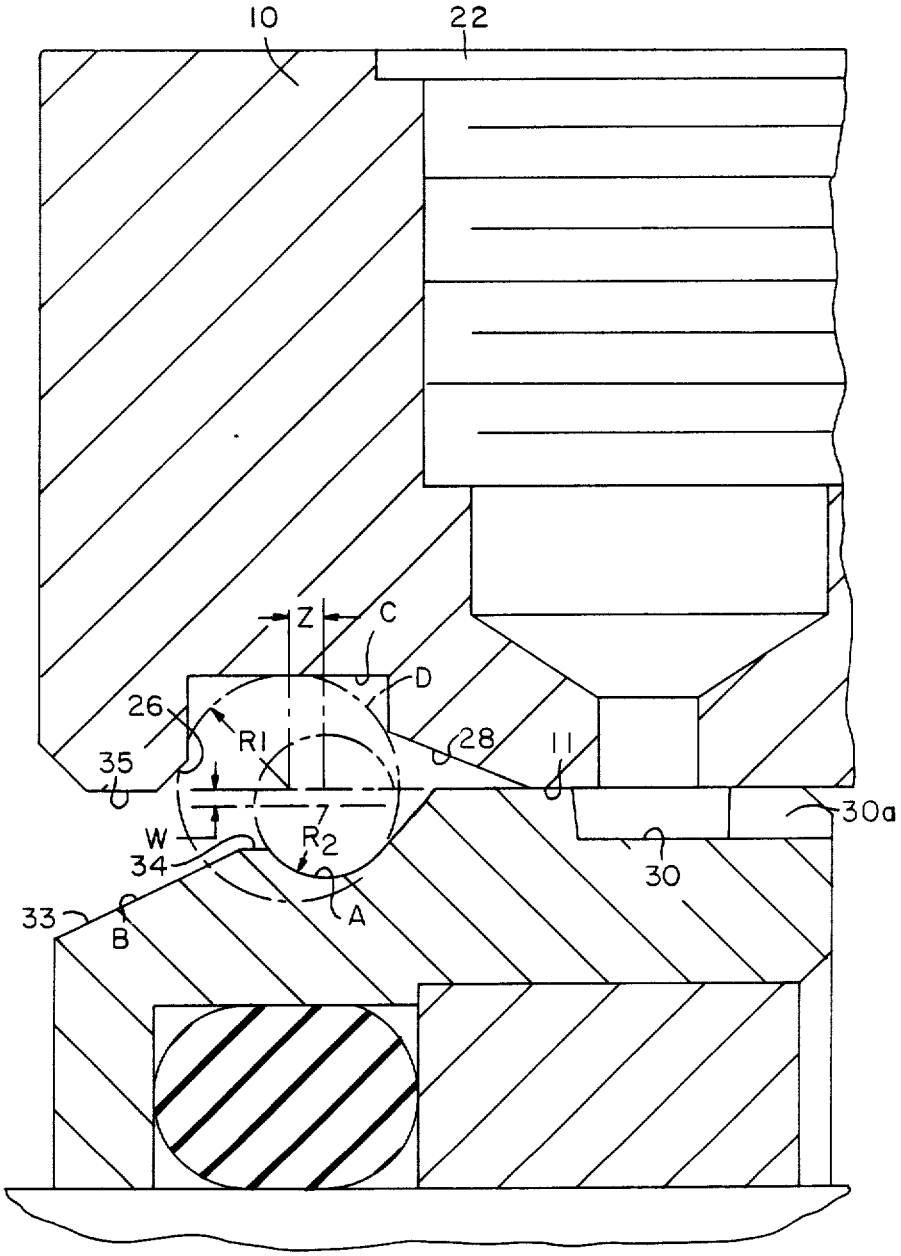
FIG. 13 is an enlarged transverse sectional elevation illustrating the mounting of an end cap within the cylinder.

The end caps 31 and 32 provide a seal at each end of the cylinder. The end cap 32 is provided with an O-ring 32a to form a sealing relationship with the piston rod 12 which slides therein. The end caps 31 and 32 are each provided with a first circumferential groove A which is generated for the most part by a radius of a circle R2 which is smaller than the radius R1 of the O-ring D as is best seen in FIGS. 12 and 13 and which is spaced axially inwardly of a second circumferential groove C. The center of the radius R2 is spaced radially below the center of the radius R1 by the amount W and inwardly thereof by the amount Z as illustrated in FIG. 13. The ramp 33 which forms a part of the reduced end portion B is preferably of substantially conical configuration and joins with the groove A by a cylindrical portion 34. Defining a retaining ridge, the apex of which is flat cylindrical portion 34, the second circumferential groove C includes the tapering surface 28 which is at an angle of about 20° with the inner wall 11 of the cylinder.

Assembly of the cylinder and end caps is facilitated by the ramp member 33 which passes within the O-ring D as illustrated in FIGS. 10–13. The retaining ridge 34 presses inwardly against the O-ring D at a point short of the center line thereof by the amount X illustrated in FIG. 12. Thus, pressure is exerted against the O-ring at its point of maximum effectiveness which is short of the center line. The inner edge of the retaining ridge which is a juncture between the groove A and the cylindrical surface 34 defining the apex of the retaining ridge is spaced inwardly of the groove C by the amount Y as illustrated in FIG. 12. The construction described provides a blowout pressure for the end caps, for example 5,000 pounds, while a 30 pound pressure is required to disassemble the end caps from the cylinder by pressing inwardly against the end caps. Such pressures are achieved by utilizing a distance X of 0.01 inch and providing a bevel of 0.01 inch at 45 degrees at the bevel 26. The groove C is 0.065 inches across at the base and has a depth of 0.035 inches with respect to the inner diameter of the cylinder 35. The disassembly operation is substantially the opposite of the assembly described above and in FIGS. 9–12 of the drawings. First, one of the end caps would be removed by pressing same inwardly past the O-ring and then removing the O-ring preparatory to removing the first of the end caps. The other cap may be similarly removed. While an O-ring, as described, or ring of other arcuate cross-section is preferred, a square ring may be utilized. The groove of the end cap has a curvature greater than that of the ring or other depression for deforming the deformable ring to a substantial degree as illustrated.

Figures 14, 15:
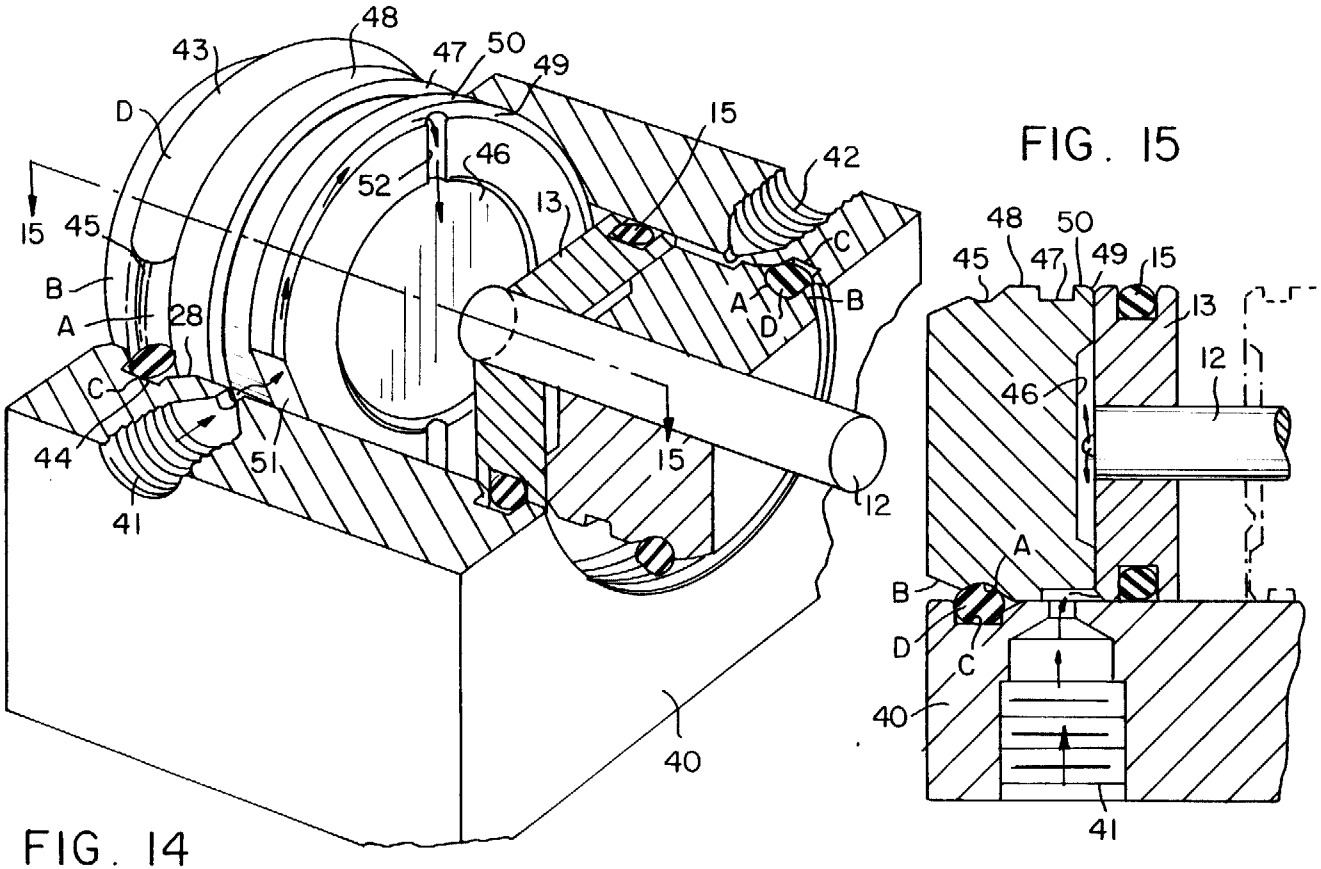
FIG. 14 is a perspective view illustrating a cylinder constructed in a modified form of the invention especially designed for enhanced fluid distribution to cushion against noise and shock while providing enhanced breakaway characteristics for the piston. The cushion afforded by the mounting ring of deformable material is enhanced by the air's cushioning effect between the piston and the respective end caps.
FIG. 15 is a longitudinal sectional elevation illustrating the end cap with mounting and air distribution means opposite a piston.

FIGS. 14 and 15 illustrate a modified form of the invention wherein a cylinder housing is illustrated at 40. A pair of fluid ports 41 and 42 are provided adjacent respective ends of the cylinder within the walls. Deformable mounting rings are illustrated at 43 and are carried in respective grooves 44 within the cylinder wall and 45 within the end caps. The end caps include in addition to the annular seat 45 a ring of resilient deformable material 43 carried partially therein.

The fluid operated cylinder has a piston 13 and piston rod 12. The end cap receives fluid under pressure through the cylinder wall and has a terminal recess 46 opposite the piston. The annular seat 45 in the end cap is adjacent an end thereof remote from the piston. The ring of resilient deformable material 43 is carried partially within said annular seat positioning the end cap within the cylinder. An annular groove 47 in the end cap is carried in axially spaced relation to the annular seat. A first annular section 48 has a first peripheral surface on the end cap between the annular seat and the annular groove. An annular terminal recess 49 is provided in the end cap. A second annular section has a second peripheral surface 50 on the end cap between the annular groove and the annular terminal recess. A first passageway 51 is provided in the second annular section providing a connection for fluid flow between the annular groove and the annular terminal recess. A second passageway 52 extends from the annular terminal recess across an adjacent end of the end cap to the terminal recess. The second passageways 52 may be opposite each other and in spaced relation to the first passageways although they may be aligned or otherwise spaced.

It is important that the mounting ring 43 of resilient deformable material provide a cushion against sound and shock avoiding excessive noise and wear on the parts. Moreover, the cushion afforded by the terminal recess in the end caps and fluid delivery means provides cushioning against sound and shock. The resilient mounting also provides use in assembly and disassembly by providing for spaced contacting surfaces afforded by the annular sections 48 and 50 and opposing surfaces of the inner wall of the cylinder stability of the end caps is afforded plus the ability to make shorter cylinders.

While a preferred embodiment of the invention has been described using specific terms, such description is for illustrative purposes only, and it is to be understood that changes and variations may be made without departing from the spirit or scope of the following claims.

What is claimed is:

1. For use in a fluid operated cylinder having a piston and a fluid port, an end cap receiving fluid under pressure through said fluid port and having a terminal recess opposite said piston comprising:

an annular seat in said end cap adjacent an end thereof remote from said piston;

a ring of resilient deformable material carried partially within said annular seat positioning said end cap within said cylinder;

an annular groove in said end cap adjacent to and in axially spaced relation to said annular seat;

an annular terminal recess in said end cap adjacent to and in axially spaced relation to said annular groove;

a first annular section having a first peripheral surface on said end cap between said annular seat and said annular groove;

a second annular section having a second peripheral surface on said end cap between said annular groove and said annular terminal recess;

a first passageway in said second annular section providing a connection for fluid flow between said annular groove and said annular terminal recess; and a second passageway extending from said annular terminal recess across an adjacent end of said end cap to said terminal recess.

2. A fluid operated cylinder having a cylinder wall, a piston and a fluid port comprising:

an end cap receiving fluid under pressure through said fluid port;

a terminal recess in said end cap opposite said piston;

a resilient deformable mounting means removably positioning said end cap within said cylinder adjacent an end remote from said piston;

an annular groove in said end cap in axially spaced relation to said mounting means;

an annular section having a peripheral surface on said end cap;

an annular terminal recess in said end cap;

a first passageway in said annular section providing a connection for fluid flow between said annular groove and said annular terminal recess; and a second passageway extending from said annular terminal recess across an adjacent end of said end cap to said terminal recess.

* * * * *